United States Patent [19]

Faust

[11] 4,262,901

[45] Apr. 21, 1981

[54] SAFETY DEVICE FOR USE IN BAR BELL EXERCISES AND THE LIKE

[76] Inventor: Reginald O. Faust, 41 Oak Ct., Annapolis, Md. 21401

[21] Appl. No.: 77,532

[22] Filed: Sep. 21, 1979

[51] Int. Cl.[3] ..... A63B 21/06

[52] U.S. Cl. ..... 272/117; 272/144; 272/DIG. 4

[58] Field of Search ..... 272/177, 118, 116, 123, 272/134

[56] References Cited

U.S. PATENT DOCUMENTS

| | | | |
|---|---|---|---|
| Re. 26,606 | 6/1969 | Dodge | 272/117 X |
| 3,346,256 | 10/1967 | White | 272/123 X |
| 3,948,513 | 4/1976 | Pfotenhauer | 272/134 X |

FOREIGN PATENT DOCUMENTS

| | | | |
|---|---|---|---|
| 2328486 | 5/1977 | France | 272/118 |

*Primary Examiner*—William R. Browne

*Attorney, Agent, or Firm*—Scrivener, Clarke, Scrivener and Johnson

[57] ABSTRACT

A frame is provided which includes vertically adjustable main support arms for receiving a bar bell prior to exercising. The support arms include a unique combined brace and camming feature for guiding the bar clear of the support arms during exercising. The frame includes adjustable side frames which provide auxiliary safety support for a bar bell should an exerciser be unable to return the bar bell to the main support arms following exercising.

8 Claims, 3 Drawing Figures

SAFETY DEVICE FOR USE IN BAR BELL EXERCISES AND THE LIKE

This invention relates to exercising devices and more particularly to a safety device for use in exercising with heavy weights, particularly bar bells.

Generally there are two types of bar bell exercises, one is known as "squats," and the other known as "bench pressing." For squats exercising, the bar bell, which may weigh as much as 500 pounds, is supported on vertically adjustable arms carried by uprights and positioned slightly below shoulder height on vertical uprights. The exerciser, with back slightly bent, backs into the bar, grasps it with both hands stands erect to raise the bar from the arms, and thereafter does deep knee bends, or "squats" with the bar supported by his hands and on his shoulders behind his head.

In bench pressing, a padded bench, which may be horizontal or inclined, is positioned between the uprights and the support arms are lowered to a point slightly less than the outstretched grasp of the exerciser lying on his back on the bench. To exercise, the exerciser grasps the bar, lifts it off the support and then raises and lowers it over his chest a number of times.

Heretofore, in either squats or bench pressing it has been mandatory that the exerciser always work with the heavy bar bells in the presence of others, known as spotters, in order to avoid grave injury to the exerciser in the event he has exausted his strength and is unable to return the bar bell to the support arms. In bench pressing, unless the exerciser can call for assistance from spotters to lift the weight to allow the exerciser to escape, there is nothing the exerciser can do and if the weight were to come to rest on his chest, it might be crushed and the exerciser fatally injured. There is a similar danger in squats exercising. When the exerciser is unable to stand erect to replace the bar bell on the arm supports, he is usually trapped, so to speak, in a squatting position and, if no spotters were present, he could only release the bar bell by letting it roll down his inclined back. This could cause serious injury to the spinal cord.

The object of the present invention is to provide a device which permits an exerciser to exercise with a bar bell by himself and in the event of an emergency, provides auxiliary support on to which the bar bell can be lowered to be supported in a position, clear below the normal range of movement of the bar bell during exercising, but high enough that when engaged by the bar bell, the latter is supported in a position which allows sufficient room for the exerciser to escape from beneath the bar bell.

Another object of the invention is to provide the safety device as part of a bar bell exercising rack or frame having specially designed adjustable main support arms readily positioned for either squat or bench press exercising.

Other objects and their attendant advantages will become apparent as the following detailed description is read in conjunction with the accompanying drawings wherein.

Figure 1:
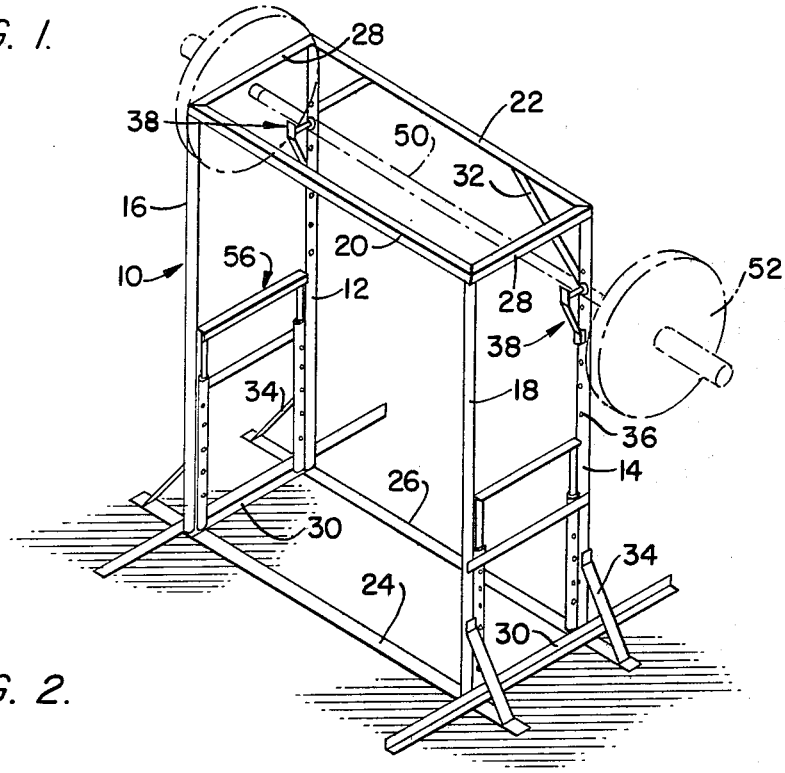
FIG. 1 is a perspective view of an exercising frame constructed in accordance with the invention and incorporating the safety device of the invention.

With reference to the drawings, the invention comprises a frame 10 having a pair of rear uprights 12, 14 and a pair of front uprights 16, 18. The upper and lower ends of the uprights are rigidly connected together by front and rear frame elements 20, 22 and 24, 26 and side frame elements 28 and 30. The frame elements and uprights are interconnected by suitable upper and lower braces 32, 34. It will be observed that the lower side frame elements 30 extend rearwardly and forwardly substantially beyond the frame defined by the uprights. The purpose of these extensions is to restrain the frame from tipping should it be accidently struck by a bar bell during exercising.

Figure 3:
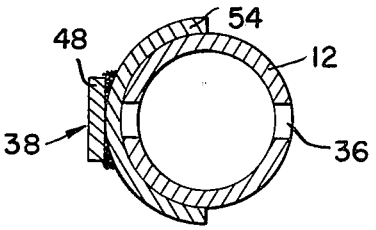
FIG. 3 is an enlarged horizontal cross sectional view taken substantially on the line 3—3 of FIG. 2 showing details of the main support arm of the invention.

The rear uprights have extending therethrough a plurality of vertically spaced horizontal openings 36 adapted to cooperate with arms 38 for supporting a bar bell in a preselected position on the frame prior to the commencement of a particular type of exercise. In accordance with the invention each arm 38 comprises a horizontal, pin-like element 40 adapted to extend through a selected one of the openings 36. The element 40 carries a rigid collar 42 and has a threaded end 44 which extends through the opening on the side of the upright remote from the collar. The threaded end 44 receives a suitable nut 46, preferable a wing nut as shown, which serves to clamp the upright between it and the collar 42 to rigidly fasten the element 40 to the upright. The opposite end of the element 40 extends beyond the collar in a forwardly direction and has rigidly fixed thereto the a downwardly sloping bar member 48 whose upper end extends upwardly beyond the end of the horizontal element 40 to define with it and the upright a cradle to receive the bar 50 of a bar bell 42. The bar member 48 slopes downwardly and rearwardly in the direction of the upright and has rigidly fixed to its lower end a saddle-like abutment member 54 which is complementary in shape to the exterior surface of he upright. As can be seen in FIG. 3, the saddle-like abutment member abuttingly engages the upright below the horizontal element and serves, with the bar member 48, as a brace for the horizontal element as well as a cam to guide the bar of a bar bell clear of the horizontal element 40 should the path of upward movement of the bar during exercising accidently be in line with the horizontal element.

Figure 2:
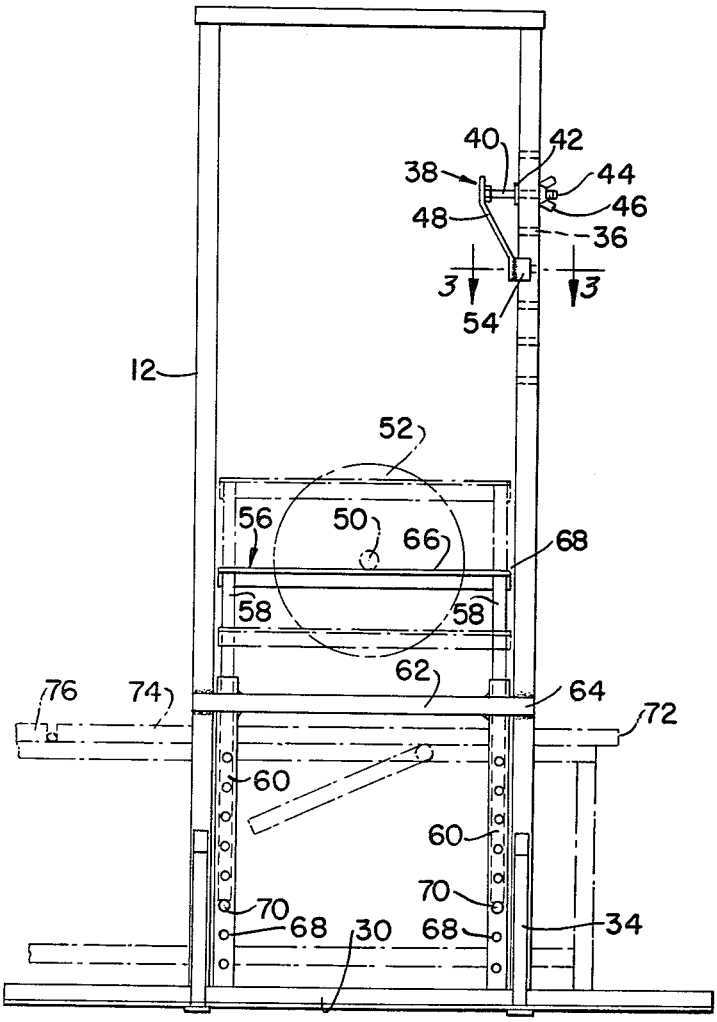
FIG. 2 is an end elevational view of the invention.

A principal feature of the invention resides in safety device in the form auxiliary means for supporting a bar bell should, during exercising, the exerciser be too exhausted to return the bar bell to the main support arms 38. As best seen in FIG. 2, the auxiliary support means comprises adjustable side frames 56 operable substantially in the vertical places defined by the respective front and rear uprights 16, 12 and 18, 14. The frames comprise leg members 58 which are telescopically received in vertical socket members 60 welded at the lower ends to the ground engaging frame members 30 and 24, 26 and which are rigidly interconnected at their upper ends by a strap member 62 having end extensions which are welded to the respective rear and front uprights 12, 16 and 14, 18. The upper ends of the leg members 58 are rigidly interconnected by horizontal channel members 66 which extend to close adjacency to the uprights to define with them a clearance which is substantially less than the diameter of the bar 50 of the bar bell 52. The socket members 60 have a plurality of horizontal openings 68 therein adapted to receive headed fastening elements 70, such as bolts, which provide abutments at preselected vertical positions for the lower ends of the legs 58.

In use, an exerciser, after determining the type of exercise, squats or bench pressing, positions the support arms 38 at the proper height. In FIG. 2, the support arms are shown located in a raised position for squats. The exerciser then locates the side frames 56 in a position, such as the upper phantom line positions, which the exerciser knows is slightly lower than the lowermost movement of the bar bell during the squat exercise. The exerciser then places the bar bell with preselected weights thereon on the arms 38 and after lifting the bar bell off the main support arms as explained above, commences the squat exercise. Should the exerciser, when in a lowered or squat position, be unable to rise again with the bar bell pressing down on his shoulders, he merely lowers himself an increment more until the weight of the bar bell is taken by the horizontal channel members 66 of the side frames.

In the event the exerciser is to do bench press exercises, he first positions a bench 72 so that the head end of the bench is properly located under the main support arms 38, which are now located in a lowered position from that of FIG. 2 at a point where the exerciser, lying on his back on the bench, is able, with outstretched arms, to raise the bar bell off of the main support arms 38. The exerciser then locates the side frames in a position which will be slightly above his chest when he is lying on the bench but below the normal lowermost range of movement of the bar bell during exercising. In the event the exerciser is unable to return the bar bell to the main support arm 38 after exercising, he merely lowers it an increment until it rests on the horizontal channels 66 where upon the exerciser slides underneath the bar of the bar bell and off of the bench.

The bench 72 may be of the type having front and rear parts 74, 76 which may be locked in mutually inclined positions relative to the horizontal frame of the bench. Where an exerciser elects to perform inclined bench press exercises, he would again position the main arms 38 and side frames to preselected positions appropriate to the exercise.

It will be apparent to those skilled in the art that instead of the sockets being fixed to the frame, the legs could be so fixed and the sockets be telescopically moveable over the legs. The invention is susceptible of these and a variety of other changes and modifications without, however, departing from the scope and spirit of the appended claims.

What is claimed is:

1. A device for use in exercising with a bar bell comprising a frame having a pair of spaced vertical rear uprights and a corresponding pair of spaced vertical front uprights, the corresponding front and rear uprights of each pair lying in parallel vertical planes, a bar bell support arm carried by each of the rear uprights and being vertically positionably on said rear uprights for supporting a bar bell at a height appropriate to a selected bar bell exercise, vertically adjustable safety support means carried by said frame between each pair of front and rear uprights, means for fixing said safety support means on said frame at a height wherein said support means are sufficiently below the normal range of downward movement of a bar bell during a selected exercise so as not to interfere with exercising but at a height to be readily engaged by a bar bell when the latter is lowered beyond the normal range of movement whereby in an emergency the weight of a bar bell can be sustained by the safety support means at a height enabling an exerciser to escape beneath the bar bell without danger of injury, said safety support means comprising telescopically arranged vertically extending sets of leg and socket members, one member of each set being rigidly fixed to the frame substantially within the vertical plane defined by each pair of front and rear uprights, a horizontal bar rigidly fixed to the one member of each set which is telescopically moveable with respect to the member rigidly fixed to the frame, said bar lying substantially within the vertical plane defined by each pair of front and rear uprights, and fastening means cooperating with each set of leg and socket members for adjustably fixing the telescopically moveable member and its horizontal bar on the rigidly fixed member at a height corresponding to the selected type of bar bell exercise.

2. The device of claim 1 wherein there is a set of leg and socket members adjacent each upright and the horizontal bar rigidly connects the upper ends of the two moveable members which are adjacent each pair of front and rear uprights.

3. The device of claim 1 wherein the fastening means comprises a plurality of vertically spaced horizontally extending openings in one of each set of leg and socket members, and a headed fastening element insertable into a selected one of said horizontal openings for engagement by the telescopically moveable one of said members of a set to retain said one of said members and hence said bar at a predetermined height suited to a bar bell exercise.

4. The device of claim 1 wherein the end of the horizontal bars are spaced from their corresponding uprights a distance sufficiently smaller than the diameter of the bar of a bar bell so that a bar of a bar bell cannot drop downwardly between the uprights and the ends of the horizontal bars.

5. The device of claim 1 wherein the uprights and one of each set of leg and socket members are rigidly connected at their lower ends to a horizontal ground engaging frame having front and rear parts and spaced side parts, the side parts extending forwardly and rearwardly substantially beyond the corresponding uprights to restrain the said device against tipping upon accidental engagement of the uprights by a bar bell during exercising.

6. A device for use in exercising with a bar bell comprising a frame having a pair of spaced vertical rear uprights and a corresponding pair of spaced vertical front uprights, the corresponding front and rear uprights of each pair lying in parallel vertical planes, a bar bell support arm carried by each of the rear uprights and being vertically positionable on said rear uprights for supporting a bar bell at a height appropriate to a selected bar bell exercise, vertically adjustable safety support means carried by said frame between each pair of front and rear uprights, means for fixing said safety support means on said frame at a height wherein said support means are sufficiently below the normal range of downward movement of a bar bell during a selected exercise so as not to interfere with exercising but at a height to be readily engaged by a bar bell when the latter is lowered beyond the normal range of movement whereby in an emergency the weight of a bar bell can be sustained by the safety support means at a height enabling an exerciser to escape beneath a bar bell without danger of injury, each bar bell support arm comprising a horizontal element receivable in a selected one of a plurality of vertically spaced horizontal openings extending through the rear uprights, a collar on said element to locate it in an opening on the upright with a threaded end of said element projecting beyond the upright on the side thereof remote from the collar, a threaded nut member received on said threaded end to clamp said upright between said nut and said collar, the opposite end of said arm extending beyond said collar in a forwardly direction, a downwardly extending bar member rigidly fixed to said opposite end of said arm and extending upwardly beyond said end to define with said element and said upright a cradle to receive the bar of a bar bell prior to exercising, said bar member sloping downwardly from the end of said arm in the direction of said upright, and a saddle-like abutment member complementary in shape to the exterior surface of the upright and rigidly fixed to the lower end of said bar, said saddle-like abutment member engaging said upright, the sloping portion of said bar serving to cam a bar of a bar bell away from said horizontal element should the path of movement of said bar be accidently in line with said horizontal element during exercising.

7. A device for use in exercising with a bar bell comprising a horizontal frame, vertically adjustable safety support means carried by said frame, said support means including horizontal bar means extending in a direction which is substantially normal to the vertical path of movement of a bar bell during exercising, said horizontal bar means having a length such that during exercising the bar means at all times intersects the normal path of movement of a bar bell, means for adjustably fixing said safety support means on said frame at a selected height wherein said bar means are sufficiently below the normal range of downward movement of a bar bell during a selected exercise as not to interfere with exercising but at a height to be readily engaged by a bar bell when the latter is lowered beyond the normal range of movement whereby in an emergency or at the conclusion of exercising the weight of a bar bell can be sustained by the safety support means at a height enabling an exerciser to escape beneath the bar bell wilthout danger of injury, said frame having a rear part and two side parts normal to the rear part, said safety means comprising telescopically arranged vertically extending sets of leg and socket members, one member of each set being rigidly fixed to each of said side parts of said frame, said horizontal bar means comprising a rigid horizontal bar rigidly fixed to the other member of each set which is telescopically moveable with respect to the one member rigidly fixed to a frame side part, fastening means for adjustably fixing the telescopically moveable member and its horizontal bar on the rigidly fixed member at a height corresponding to a selected type of bar bell exercise.

8. The device of claim 7 including means for preventing a bar bell from rolling off said horizontal bar and dropping free thereof.

* * * * *